US005900069A

United States Patent [19]

Llerena

[11] Patent Number: 5,900,069

[45] Date of Patent: May 4, 1999

[54] PORTABLE GOLF BALL WASHER

[76] Inventor: Richard Lee Llerena, 9389 Baldwin Rd., Kirtland Hills, Ohio 44060

[21] Appl. No.: 08/906,031

[22] Filed: Aug. 5, 1997

[51] Int. Cl.[6] ..... A63B 47/04; B08B 1/00

[52] U.S. Cl. ..... 134/6; 15/21.2; 15/104.92; 15/160

[58] Field of Search ..... 15/21.2, 104.92, 15/160; 134/6, 32

[56] References Cited

U.S. PATENT DOCUMENTS

| | | | |
|---|---|---|---|
| 293,650 | 2/1884 | Gorman | 15/104.92 |
| 1,758,011 | 5/1930 | Reach . | |
| 2,822,558 | 2/1958 | Vandervort . | |
| 3,044,089 | 7/1962 | Boynton | 15/21.2 |
| 3,101,497 | 8/1963 | Derkocz . | |
| 3,102,291 | 9/1963 | Frater | 15/21.2 |
| 3,678,526 | 7/1972 | Burkholder . | |
| 4,344,203 | 8/1982 | Gerrick . | |
| 4,559,662 | 12/1985 | Kunold, Jr. | 15/104.92 |
| 4,683,603 | 8/1987 | Purlia et al. . | |
| 4,701,968 | 10/1987 | Stoltzman . | |
| 4,750,232 | 6/1988 | Doney . | |
| 4,805,251 | 2/1989 | Hollrock . | |
| 4,965,906 | 10/1990 | Mauro . | |
| 4,970,746 | 11/1990 | Brackmann . | |
| 5,215,136 | 6/1993 | Flanders et al. . | |
| 5,555,586 | 9/1996 | Dorrich | 15/21.2 |
| 5,638,567 | 6/1997 | Danyluk | 15/21.2 |

*Primary Examiner*—Randall E. Chin
*Attorney, Agent, or Firm*—Renner, Otto, Boisselle & Sklar, P.L.L.

[57] ABSTRACT

A portable golf ball washer is characterized by a container having a top end and a bottom end. A plunger is connected to the top end and is opposed by a return assembly mounted on the bottom end. The ball washer also has a scrubbing material inside the container. The plunger pushes a golf ball through and against the scrubbing material and then the return assembly automatically pushes the golf ball back through and against the scrubbing material to produce a clean golf ball. The ball washer may also include an ejection mechanism to facilitate removal of the golf ball from the ball washer, and the bottom end may be detached to facilitate cleaning and repairing the golf ball washer.

19 Claims, 3 Drawing Sheets

PORTABLE GOLF BALL WASHER

FIELD OF THE INVENTION

The invention herein described relates generally to a cleaning device for a ball and more particularly to a golf ball washer.

BACKGROUND OF THE INVENTION

A dirty golf ball will not travel as far or as straight as a clean golf ball. Accordingly, golf courses often provide equipment for washing golf balls at the clubhouse and other locations around the course, usually at or near the tee box. These ball washers are stationary, generally supported on a post. Golf balls, however, often become soiled in areas of the course away from such stationary devices, and it would be desirable to provide a golf ball washer which is portable and could be carried by a golfer. It would also be desirable to have a golf ball washer which could be attached to a golf bag or a golf cart to make it easier to carry.

Previous portable golf ball washers included mechanisms for advancing and retracting the ball. Typically, they required a holding mechanism for engaging the ball, such as a bail-like wire. However, a golf ball can be difficult to insert into and remove from the holding mechanism, and the wires can deform over time until they can no longer maintain a strong grip on the ball. Also, these devices are often formed of parts and/or assemblies which do not lend themselves to easy fabrication.

Furthermore, after several cleaning sessions, the golf ball washer itself may become soiled and require cleaning as well. Dirt typically settles to the bottom of the washer and/or becomes entrained within the scrubbing bristles of the washer which makes cleaning difficult. Previous golf ball washers typically only opened at the top or merely provided a small drain to facilitate removal of dirty cleaning fluid. These drains may be clogged, however, and do not facilitate removal of the dirt that is not carried away by the fluid. Top opening ball washers also inhibit cleaning the bottom of the ball washer, where the dirt often settles and make repairing inner elements of the ball washer difficult. Therefore, providing a golf ball washer which is not only portable but also easy to clean and repair would also be desirable.

SUMMARY OF THE INVENTION

The present invention provides a portable golf ball washer that is easy to use, clean and repair. The golf ball washer is characterized by a container having a plunger at the top which is opposed by a spring on the bottom. In a preferred embodiment, the bottom end of the container with the spring is removable to facilitate cleaning and repairing the golf ball washer.

Also in the preferred embodiment, the plunger includes a movable rod and may also include a handle at one end of the rod outside the container. The spring is mounted at the opposing end of the container to oppose the motion of the rod as a ball is moved therebetween and against a scrubbing material inside the container. The scrubbing material includes a plastic carpeting and/or a liquid cleaning solution.

A return plug may be attached to a free end of the spring, and a plunger plug may be attached to an end of the rod inside the container. The return plug and the plunger plug cooperate to retain the golf ball between the rod and the return spring during a cleaning operation. The ball washer also preferably includes a door in the side of the container and an ejection mechanism, such as a spring, mounted inside the container. The ejection mechanism facilitates retrieval of the ball from the ball washer, particularly when the ball washer is attached to a golf cart.

According to a preferred method of washing a golf ball, a golf ball is inserted into the ball washer, and the plunger is pushed to move the ball against and along the scrubbing material to clean the surface of the ball. The ball is held against the plunger by the return spring which also functions to automatically return the ball to a return position for removal upon release of the plunger. The steps of pushing the plunger and allowing the return spring to return the golf ball to a return position may be repeated several times to ensure that the golf ball is clean before it is removed.

According to another aspect of the invention, the golf ball washer may be easily cleaned and/or repaired by removing the bottom end of the container, cleaning and repairing the inside of the golf ball washer, and replacing the bottom end of the container.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION OF THE INVENTION

Figure 1:
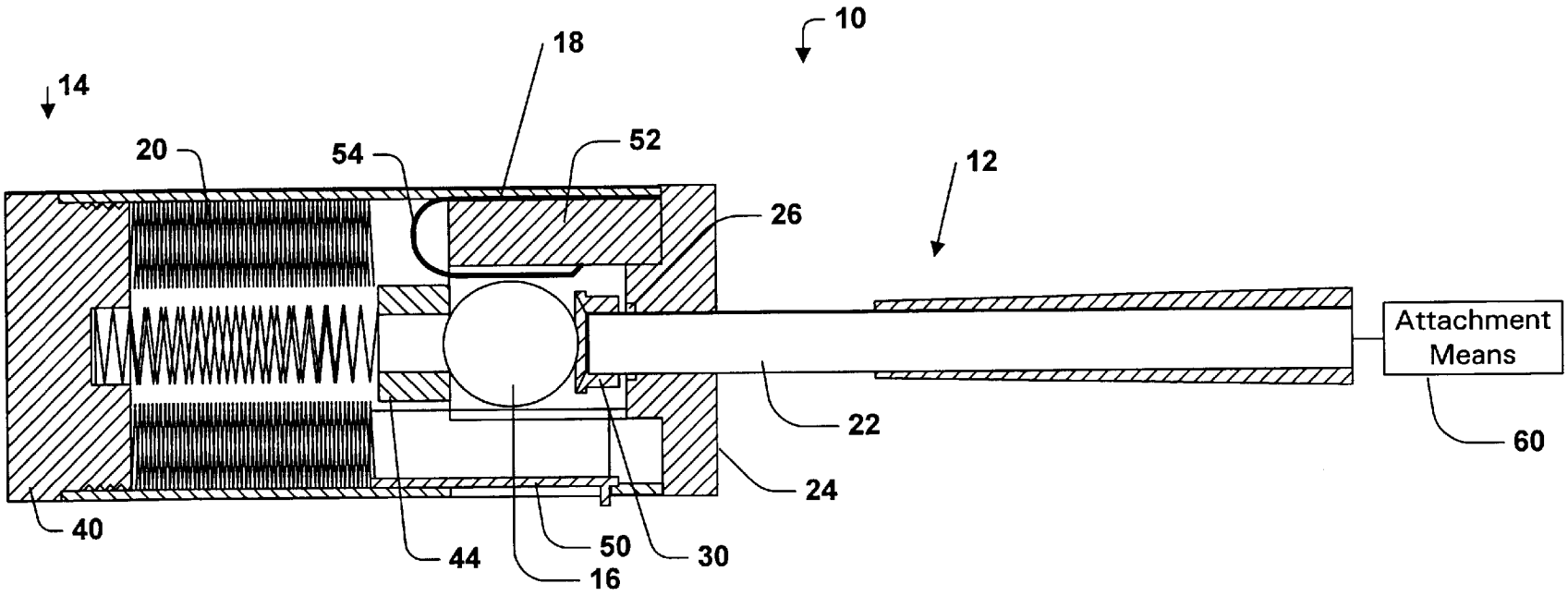
FIG. 1 is a sectional view of a golf ball washer, according to the present invention.

Referring now to the drawings in detail, and initially to FIG. 1, an exemplary embodiment of a portable golf ball washer according to the present invention is designated generally by reference numeral 10. In the illustrated ball washer 10, a plunger 12 and a return assembly 14 cooperate to move a golf ball 16 in a reciprocating fashion through a container 18. In the process, the golf ball 16 moves through and/or against a scrubbing material 20 in the container 18 whereby the golf ball 16 is cleaned. The structure, function, and use of the ball washer 10 is described in more detail below.

As illustrated in FIG. 1, the plunger 12 is connected to a top end 24 of the container 18 and includes a rod 22 which passes through a hole therein. In the illustrated embodiment, the top end 24 is a separate element attached to the container 18. However, the top end 24 may be formed as an integral part of the container 18. A plunger seal 26 which surrounds the rod 22 is mounted in the top end 24. The plunger seal 26 prevents dirt and/or liquid from passing through the hole through which the rod 22 passes.

The plunger 12 also has a handle 28 on an outer end portion of the rod 22 to facilitate gripping the plunger 12 and using it to move the golf ball 16. In the illustrated and preferred embodiment, the handle 28 is in the form of a golf club grip wrapped around the outer end portion of the rod 22. Other types of handles and grips may be substituted, such as a T-shaped handle, a molded hand grip, or a lever type handle.

The plunger 12 also includes a plunger plug 30 connected to an end of the rod 22 inside the container 18. The plunger plug 30 has an annular sloped surface forming a cupped recess for engaging the golf ball 16 to minimize or prevent lateral motion.

Figure 4:
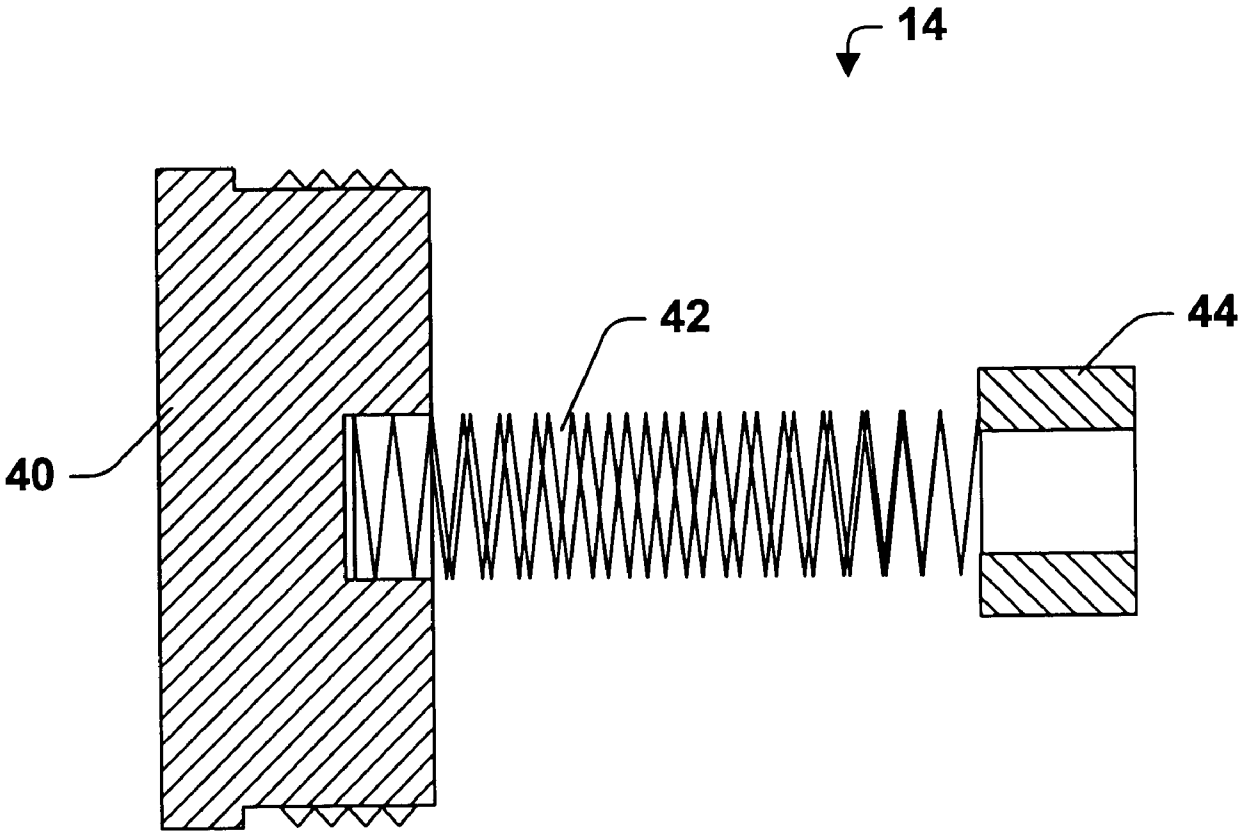
FIG. 4 is a sectional view of the base assembly of the golf ball washer.

Referring now to FIGS. 1 and 4, the return assembly 14 is mounted on a bottom end 40 of the container 18. The bottom end 40 is detachably connected to the container 18 and provides access to the inside of the container 18 for cleaning and repairing the ball washer 10. In the illustrated embodiment, the bottom end 40 threadably engages the container 18; however, the bottom end 40 may be detachably coupled to the container 18 in other ways. One alternative would be to provide a bottom end 40 which can be removed from the end of the container 18 but is still connected to the container 18 by some means such that the open end of the container 18 is not obstructed by the bottom end 40. This would be advantageous as a way to avoid dropping the bottom end 40 and perhaps losing it while the ball washer 10 is being cleaned.

The return assembly 14 includes a return spring 42 which is mounted to the bottom end 40 as mentioned above. When the bottom end 40 is connected to the container 18, the return spring 42 extends into the container 18. In the illustrated embodiment the return spring 40 is a cylindrical compression spring. Alternatively, a conical compression spring which is wider at its base may be used as the return spring 40 in situations where space is critical, since a conical spring will compress to a flatter condition than a cylindrical spring.

The return assembly 14 further includes a return plug 44 connected to the distal or free end of the return spring 42. The illustrated return plug 44 includes a hole therethrough to permit the passage of fluid. Functionally, the return plug 44 cooperates with the plunger plug 30 to retain the golf ball 16 between the plunger 12 and the return assembly 14 during operation of the golf ball washer 10. The plunger plug 30 and the return plug 44 also protect the golf ball 16 from scratches on its surface caused by the motion of the rod 22 and the return spring 42. The plugs 30 and 44 may be formed of a low-friction material and/or may be provided with bearings to facilitate rotation of the golf ball 16 thereon. Such rotation is desirable to clean all sides of the golf ball 16.

The container 18 will be described with respect to the assembled golf ball washer 10 illustrated in FIG. 1. The container 18 preferably has a generally hollow cylindrical shaped cross-section with the return assembly 14 connected to the bottom end 40 and the plunger 12 connected to the opposing top end 24, as described above. The container 18 may have other cross-sectional shapes as desired. As discussed above with respect to the plunger 12, the top end 24 may form an integral part of the top end 24 of the container 18.

A scrubbing material 20 inside the container 18 forms a cylindrical passage having a diameter slightly smaller than the golf ball 16 so that the bristles thereof brush against the golf ball 16 to remove any dirt. The scrubbing material 20 may include a durable bristled material attached inside the container 18 and preferably the scrubbing material 20 is a plastic carpet attached to a side wall of the container 18. The length and stiffness of the bristles may be selected and arranged to cause rotation of the golf ball 16 as it moves through the scrubbing material 20, thereby causing all sides of the golf ball 16 to be scrubbed clean. The scrubbing material 20 may also include liquid such as water which may further include a soap or a detergent. The interaction of the scrubbing material 20 with the motion of the golf ball 16 produced by the return spring 42 and plunger 12 cooperate to provide a clean golf ball 16.

To facilitate removal of a golf ball 16 into the golf ball washer 10, a door 50 is preferably provided in the side of the container 18. The door 50 may also have a lock (not shown) for retaining the door 50 in position. The door 50 slides down to open and closes snugly to seal the container 18 from the passage of liquid and/or dirt therethrough. The sealing of the door 50 and the opening for the rod 22 prevent liquid scrubbing material 20 from leaking out or evaporating and prevents water from leaking in, such as if the ball washer 10 is dropped in water or is used in the rain.

A door guide 52 inside the container 18 retains and guides the door 50 between its open and closed positions. In the illustrated embodiment, the door guide 52 has a thickness which reduces the size of the space about an insertion or ejection position thereby facilitating operation of an ejection mechanism 54 and ensuring that the golf ball 16 is properly positioned between the plunger plug 30 and the return plug 44. If the rod 22 is extended past the door 50, the golf ball 16 may be prevented from entering. However, no particular orientation is necessary and no extra measures are required to ensure proper placement of the golf ball 16 in the washer 10 when the rod 22 is retracted.

The ejection mechanism 54 is attached to the container 18 so that it extends toward the opening covered by the door 50. In the illustrated embodiment, the ejection mechanism 54 is a spring. Alternatively, the ejection mechanism 54 could be a spring-loaded plunger or any other mechanism which would operate to push the golf ball 16 out of the ball washer 10 when the door 50 is open. The ejection mechanism 54 is particularly important if the ball washer 10 is attached to a golf cart, since it may then be more difficult to reach inside to pull the ball 16 out, and it may not be possible to tip the ball washer 10 on its side to remove the golf ball 16.

Additionally, the golf ball washer 10 may include an attachment means 60 for attaching the golf ball washer 10 to a golf cart or a golf bag, making it easier to carry. The attachment means 60 may include screws, bolts, hooks, clips, belts or other types of attachments. In the illustrated embodiment, the attachment means 60 is connected to the rod 22 of the plunger 12 and could be a hook, for example, for hanging the ball washer 10 in a golf bag. The ball washer 10 could then be lifted out of the golf bag for use and then replaced. The attachment means 60 could also be attached to the top end 24, the bottom end 40 or the container 18. For example, the attachment means 60 could include hook and loop straps for attaching the container 18 of the ball washer 10 to a golf cart. In this arrangement, the ball washer 10 could be used without disconnecting the attachment means 60.

The weight of the ball washer 10 is desirably minimized to improve the portability of the golf ball washer 10. Accordingly, materials for its construction are preferably lightweight, durable, and water resistant.

Figure 3:
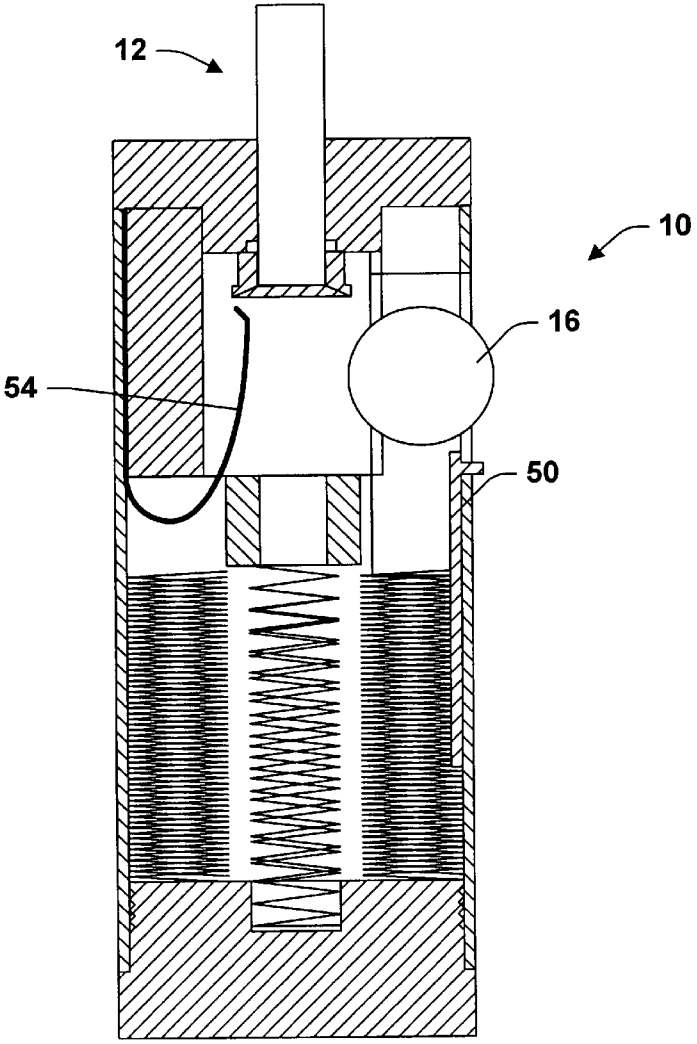
FIGS. 2 and 3 are sectional views of the golf ball washer, illustrating the method of using the invention.
Figure 2:
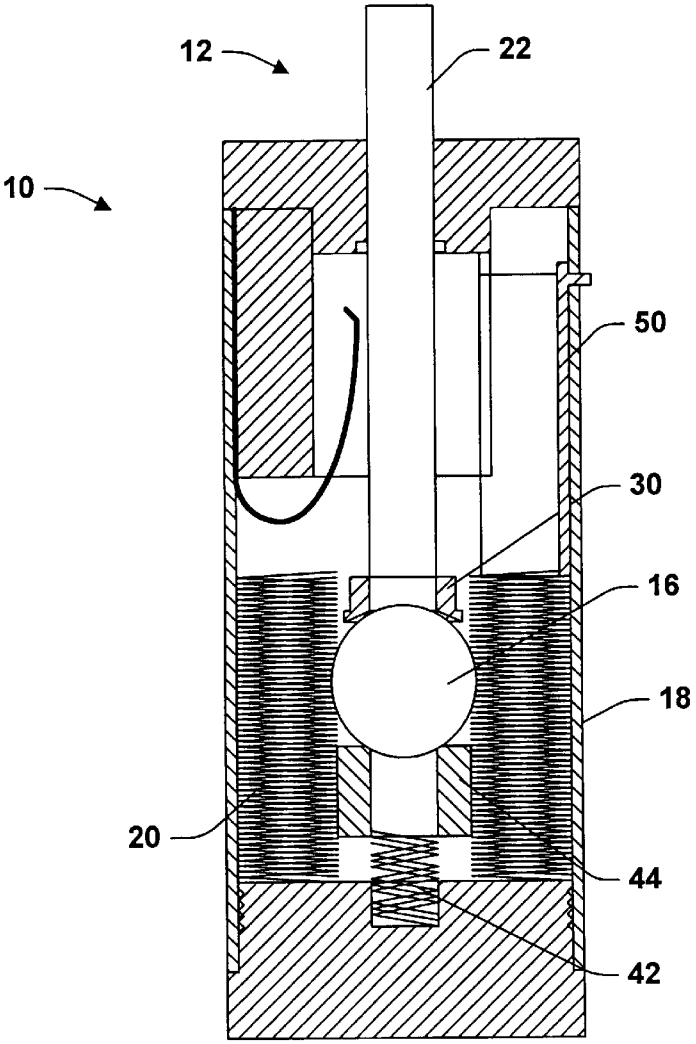

The method according to the invention will be described with reference to FIGS. 1–3. The door 50 of the ball washer 10 is opened and a dirty golf ball 16 is inserted into the golf ball washer 10 (see FIG. 3). The plunger 12 may need to be retracted to permit insertion of the ball 16. As shown in FIG. 1, the door 50 is closed and the plunger 12 contacts the golf ball 16 at an initial position. The return assembly 14 ensures that the golf ball 16 maintains contact with the plunger plug 30. As the plunger 12 continues pushing against the golf ball 16, the golf ball 16 passes through the scrubbing material 20 and the return spring 42 is compressed (FIG. 2.) At the completion of the stroke, the return assembly 14 automatically pushes the golf ball 16 back through the scrubbing material 20 as the return spring 42 returns the golf ball 16, the plunger plug 30 and the rod 22 to their initial positions (FIG. 1). This process or cycle may be repeated several times before the door 50 is opened, the plunger 12 is retracted and the ejection mechanism 54 urges the cleaned golf ball 16 out of the washer 10.

Unlike ball washers which only include a liquid drain, when it is time to clean the golf ball washer 10, the bottom end 40 carrying the return assembly 14 may be detached. Any liquid scrubbing material 20 contained in the washer 10 is then easily drained and replaced even if the liquid is extremely dirty. The opening is unlikely to be clogged with dirt.

Additionally, in this condition the substantial opening provides an opportunity for the bristled scrubbing material 20 to be inspected and replaced. At this time other internal elements such as the ejection spring 54, the return spring 42, the plunger plug 30 and the return plug 44 may also be inspected and replaced, if necessary. Furthermore, if the washer 10 is maintained in an upright position, the bottom of the washer 10 will be the bottom end 40 and dirt removed from the golf ball 16 will settle there and be easily removed.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

I claim:

1. A portable golf ball washer comprising:

a container having a top end opposing a bottom end;

a scrubbing material inside the container;

a plunger including a movable rod connected to the top end; and a return assembly arranged to oppose the motion of the rod;

wherein the return assembly is mounted on the bottom end of the container;

wherein the container includes an opening through a side of the container to facilitate insertion and retrieval of a golf ball.

2. The ball washer as set forth in claim 1, wherein the bottom end is detachably connected to the container to facilitate cleaning and repairing the ball washer.

3. The ball washer as set forth in claim 1, further comprising an ejection mechanism mounted inside the container and extending toward the opening to facilitate retrieval of the golf ball.

4. The ball washer as set forth in claim 3, wherein the ejection mechanism is a spring.

5. The ball washer as set forth in claim 1, wherein the scrubbing material includes a plastic carpet.

6. The ball washer as set forth in claim 1, wherein the scrubbing material includes a liquid cleaning solution.

7. The ball washer as set forth in claim 1, wherein the return assembly includes a compression spring.

8. The ball washer as set forth in claim 7, wherein the return assembly further includes a return plug attached to the distal end of the spring, and the plunger further includes a plunger plug attached to an end of the rod inside the container, the return plug and the plunger plug cooperating to retain a golf ball between the plunger and the return assembly.

9. The ball washer as set forth in claim 1, wherein the plunger further includes a handle on an outer portion of the rod;

wherein the rod is movable relative to walls of the container to move a golf ball against the scrubbing material to clean the ball.

10. The ball washer as set forth in claim 9, wherein the handle is made of golf club grip material wrapped around the outer portion of the rod.

11. The ball washer as set forth in claim 1, wherein the top end further includes a plunger seal about a hole through which the rod passes into the container, thereby preventing the passage of liquid therethrough.

12. The ball washer as set forth in claim 1, further comprising an attachment means for attaching the washer to another object.

13. The ball washer as set forth in claim 12, wherein the attachment means is connected to a handle.

14. The ball washer as set forth in claim 1, further comprising a door connected to the container and movable to open and close the opening.

15. A method of washing a golf ball comprising the steps of:

inserting a golf ball into a ball washer having a plunger which is opposed by a return assembly;

pushing the golf ball via the plunger through and against a scrubbing material to clean the surface of the golf ball; and pushing the golf ball via the return assembly back through and against the scrubbing material;

wherein the step of inserting the golf ball includes inserting the golf ball through an opening in a side of the ball washer.

16. The method as set forth in claim 15, wherein the pushing steps are repeated several times before the golf ball is removed.

17. The method as set forth in claim 15, wherein the pushing steps include moving a golf ball against a scrubbing material which includes a bristled scrubbing material and a liquid scrubbing material.

18. The method as set forth in claim 15, wherein the inserting step includes opening a door which closes the opening in the side of the ball washer.

19. The method as set forth in claim 15, further comprising the step of removing a golf ball from the ball washer with an ejection mechanism.

* * * * *